US008857572B2

(12) United States Patent
Leutenegger et al.

(10) Patent No.: US 8,857,572 B2
(45) Date of Patent: Oct. 14, 2014

(54) ELEVATOR POSITION DETECTION WITH OPTICAL MARKING UNITS

(75) Inventors: Tobias Leutenegger, Chur (CH); Steven Freedman, Minneapolis, MN (US)

(73) Assignee: Cedes AG, Landquart (CH)

( * ) Notice: Subject to any disclaimer, the term of this patent is extended or adjusted under 35 U.S.C. 154(b) by 228 days.

(21) Appl. No.: 13/530,168

(22) Filed: Jun. 22, 2012

(65) Prior Publication Data

US 2013/0001023 A1 Jan. 3, 2013

Related U.S. Application Data

(60) Provisional application No. 61/502,002, filed on Jun. 28, 2011.

(30) Foreign Application Priority Data

Jun. 28, 2011 (EP) ..... 11005240

(51) Int. Cl.
*B66B 3/00* (2006.01)
*B66B 1/34* (2006.01)
*B66B 3/02* (2006.01)

(52) U.S. Cl.
CPC ..... *B66B 1/3492* (2013.01); *B66B 3/023* (2013.01)
USPC ..... 187/394; 187/316

(58) Field of Classification Search
CPC ..... B66B 1/24; B66B 1/2416; B66B 1/36; B66B 1/40; B66B 3/02; B66B 3/023; B66B 5/0006; B66B 5/0018
USPC ..... 187/247, 391–393, 394, 313, 316
See application file for complete search history.

(56) References Cited

U.S. PATENT DOCUMENTS 5,135,081 A * 8/1992 Watt et al. ..... 187/394
5,821,477 A * 10/1998 Gerstenkorn ..... 187/394
5,889,239 A * 3/1999 Blackaby et al. ..... 187/391
5,925,859 A * 7/1999 Miller et al. ..... 187/394
6,128,116 A * 10/2000 Dobler et al. ..... 398/106

(Continued)

FOREIGN PATENT DOCUMENTS

JP 2000-351544 A1 12/2000

OTHER PUBLICATIONS

European Search Report dated Dec. 12, 2011.

(Continued)

*Primary Examiner* — Anthony Salata
(74) *Attorney, Agent, or Firm* — Burr & Brown, PLLC

(57) ABSTRACT

An elevator device for transporting persons and/or objects within an elevator shaft of a three-dimensional formation including at least two levels, in particular a building or the like. The elevator device includes an elevator car, in which the persons and/or objects to be transported can be accommodated, a running framework for mounting and guiding the elevator car, a position determining device for determining the position of the elevator car within the elevator shaft and/or with respect to the running framework. The position determining device includes marking units for marking the position of the elevator car relative to the running framework and the elevator shaft, a detection unit for detecting and/or reading out the marking units and also an evaluation unit for evaluating the measured values of the detection unit. The marking units are formed as carriers of a barcode, in particular a 2-D code, and the detection unit is formed as an image sensor, in particular as a camera.

11 Claims, 2 Drawing Sheets

(56) References Cited

U.S. PATENT DOCUMENTS

| | | | | |
|---|---|---|---|---|
| 6,435,315 | B1 * | 8/2002 | Zaharia | 187/394 |
| 6,612,403 | B2 * | 9/2003 | Silberhorn et al. | 187/394 |
| 6,877,587 | B2 * | 4/2005 | Kunz et al. | 187/394 |
| 6,886,667 | B2 * | 5/2005 | Kunz et al. | 187/394 |
| 7,571,791 | B2 * | 8/2009 | Finn et al. | 187/394 |
| 7,597,176 | B2 * | 10/2009 | Zaharia | 187/394 |
| 7,600,613 | B2 * | 10/2009 | Kang et al. | 187/391 |
| 2002/0104716 | A1 | 8/2002 | Zaharia | |
| 2008/0060882 | A1 | 3/2008 | Nuebling | |
| 2013/0284544 | A1 * | 10/2013 | De Coi et al. | 187/394 |

OTHER PUBLICATIONS

European Office Action (Application No. 11005240.4) dated Oct. 2, 2012.

* cited by examiner

ELEVATOR POSITION DETECTION WITH OPTICAL MARKING UNITS

CROSS REFERENCE TO RELATED APPLICATIONS

This application claims the benefit under 35 USC §119(a)-(d) of European Application No. 11 005 240.4 filed Jun. 28, 2011, and claims the benefit under 35 U.S.C. §119(e) of U.S. Provisional Application 61/502,002, filed Jun. 28, 2011, the entireties of which are incorporated herein by reference.

FIELD OF THE INVENTION

The invention relates to an elevator device for transporting persons and/or objects within an elevator shaft of a building or the like, a building including the elevator device, and a position determining device.

BACKGROUND OF THE INVENTION

The prior art discloses elevators or elevator systems for buildings in which the position of the elevator cabin of the elevator car is detected on the basis of a magnetic strip. This magnetic strip is in this case often fastened to the running framework or to a guiding rail of the running framework. This running framework serves for guiding or mounting the elevator car, i.e. the running framework provides the elevator car with a guide in which the elevator car is moved or can be moved.

SUMMARY OF THE INVENTION

The present invention addresses the problem of providing an elevator device, a position determining device and a building with which improved positional determination of the elevator car is made possible.

Accordingly, an elevator device according to the present invention is distinguished by the marking unit being formed as a carrier of a barcode, in particular a 2-D code, and the detection unit being formed as an image sensor, in particular as a camera.

The elevator device according to the invention serves for transporting persons and/or objects within an elevator shaft of a three-dimensional formation or the like. Such a three-dimensional formation may be, for example, a building. For the purposes of the invention, a building should be understood as meaning any type of structure, for example, a house, a high-rise block, a tower, a hall, a stadium with a grandstand, a store, a transporting or loading station or the like. It may, however, also be some other three-dimensional formation comprising at least two levels. In principle, such a three-dimensional formation may also be, for example, a vehicle that has a building-like superstructure, for example a ship. Also conceivable, for example, are elevator devices in mobile transporting or lifting devices. Such an elevator device has an elevator car in which the persons and/or objects to be transported can be accommodated. The elevator car is moved within a running framework for mounting or guiding the elevator car. The running framework is in this case installed within an elevator shaft.

In order to determine the position of the elevator car within the elevator shaft or with respect to the running framework, there is a position determining device. This comprises at least one marking unit for marking the position, also a detection unit for detecting or reading out the marking unit and an evaluation unit for evaluating the measured values of the detection unit. This evaluation unit may be formed, for example, as an electronic unit which reads out output measured values of the detection unit and uses them for determining on this basis a position indication as to the position of the elevator car with respect to the running framework or the position within the elevator shaft.

The measure that the marking unit is formed as a carrier of a barcode, in particular a 2-D code, and the detection unit is formed as an image sensor, in particular as a camera, allows the positional determination to be improved. On the one hand, the use of a barcode or a 2-D code makes it possible to perform a simple, low-cost marking. For example, such a marking can be printed on in a simple manner with little cost. Such a marking can also be read out with standard scanners or other image sensors intended for this. Moreover, particularly error-free reading out is thereby made possible. Since the corresponding barcodes or 2-D codes can be very sharply depicted and, what is more, can also be placed very accurately with respect to the running framework or the elevator shaft, and very precise image-sensory detection is possible, the position can also be determined very precisely.

Since such barcodes or 2-D codes have a correspondingly high black-and-white contrast, these markings are often less susceptible to contaminants, such as for example due to dust. Conversely, it is also possible furthermore to determine the contrast of the detected marking units optically by means of the image sensor and, if appropriate, to output a corresponding error or warning signal or a maintenance signal, which indicates that the corresponding marking units must be cleaned or renewed. Such a maintenance or error signal may, for example, be output by the evaluation unit, in which the contrast may also be determined. Moreover, a barcode or 2-D code can advantageously be read out contactless and, what is more, is also virtually wear-free.

Correspondingly accurate detection is made possible by image sensors which have a corresponding optical system, such as for example telemetric lenses. Furthermore, it is made possible to provide image sensors that are as compact and small as possible.

This simple and compact configuration makes it possible that only low costs are incurred for the positional determination. Moreover, such positional determination makes low power consumption possible, since often only low power is usually required for the corresponding electronics.

In the case of a preferred embodiment of the invention, the marking unit is also formed as a strip; this measure makes continuous marking of the position along the run of the elevator car possible. Each individual marking can be separated from the next marking by a corresponding symbol, for example a separating strip, so that a fine incrimination is also made possible.

In the case of a preferred embodiment of the invention, the marking unit is attached to the running framework, in particular to a guiding rail of the running framework. In the case of such a configuration, it is made possible, for example, that the marking is not concealed by struts or the like when the elevator car travels past. Moreover, it can in this way be achieved that a specific, exactly defined distance between the sensor/image sensor and the marking unit is always maintained. On the one hand, this allows the accuracy of the measurement to be increased and, on the other hand, this measure also makes simplified installation and maintenance possible. In particular, the positional determination does not have to make allowance for any influence with regard to a measurement that could be caused by a change in the distance between the marking strips and the sensor. A small distance between the marking strips and the sensor usually makes it possible for the positional determination to be performed precisely.

After they have been constructed, building structures may also "settle" over time, i.e., for example, walls may change their position and be displaced slightly. Such changes are known in structural engineering and structural physics and are caused, for example, by effects of ageing and loads. Changes due to seismic activities or other changes of the subsoil (for instance caused by subsidence, groundwater, etc.) are also conceivable. However, these displacements are not always linear or uniform. If such a displacement occurs, this may mean that the building is displaced in a way that is different than, for example, the running framework in which the elevator car is guided. A further advantage of attaching the marking unit to the running framework may consequently be that of making it possible for the position of the marking unit to be at least partially isolated from displacements of the building. If, therefore, a corresponding marking unit is fastened directly to the building, for example to a wall of the building, it may change its relative position with respect to detection by an image sensor of an elevator car that can travel in the running framework. If no allowance were made for this effect, this could lead to the positional determination being less accurate after a certain time in which the building or individual walls is/are displaced than when the elevator was installed; correspondingly, the shaft opening could then possibly no longer be approached precisely by the elevator cabin.

In principle, however, the marking unit may also be attached to the elevator shaft or to some other part, for example a wall of the building.

Furthermore, in the case of a development of the invention, at least a first and a second marking unit are provided. This may be accompanied by several advantages: Firstly, a second marking unit may be used as a reference marking for adjusting the accuracy of the first marking unit. For example, the evaluation unit may perform such an adjustment, if appropriate automatically in specific time intervals. This allows the elevator device to establish whether a change has taken place over time with respect to the relative position between the first marking unit and the second marking unit. This may be used for maintenance purposes but also in principle for building safety. Moreover, this allows a calibration of the position determining device to be performed, so that even more precise positional determination is made possible. Such a calibration may be performed in the evaluation unit. The second marking unit may, for example, be attached in the vicinity of the shaft opening, for example on every floor.

A second marking unit may also be used, however, for transmitting further information. For example, the second marking unit may be used for marking a specific zone along the run within the elevator shaft.

Moreover, the evaluation unit may in turn be designed for determining whether or not the elevator car is located within this zone. Such a zone may be, for example, the area around a shaft opening in which it is possible for persons located in the elevator car to exit. Typically there is a shaft opening on every floor, if appropriate even two shaft openings, if for example exiting on opposite sides is possible.

Depending on the type of elevator, either the elevator car has a door or exit hatch or, conceivably, the elevator shaft itself has a corresponding door or exit hatch. Accordingly, in the case of a development of the invention, there may be an unlocking device for unlocking a door or an exit hatch of the elevator car, which device can be controlled by means of an evaluation device. The purpose of such an unlocking device is to make emergency exiting possible if there is an elevator defect, but only when the elevator car is in the area of a shaft opening. It is likewise conceivable for the unlocking device to unlock the door of a shaft opening of the elevator shaft, that is to say a door that is not attached directly to the elevator car. For the purposes of the invention, control means closed-loop and/or open-loop control. For example, depending on whether the elevator car is within the zone, the locking device can or cannot be activated.

In the case of a configurationally variant, the detection unit may be arranged on top of and/or underneath the elevator car. It is also conceivable for the detection unit to be attached to the elevator car at some other position. This means that the marking unit is fixedly attached, for example to the running rail or to the building, while the elevator car, which can perform a movement in relation to this marking unit, has the corresponding detection unit, which can, depending on its position with respect to the marking unit, then provide corresponding positional indications on the basis of the evaluation device. However, in principle it is conceivable, for example, for the detection unit also to be attached laterally to the elevator car. Allowance for the position of the detection unit in relation to the elevator car should generally be made, inter alia, in the evaluation of the position of the elevator car by the evaluation device, i.e. the latter must be accordingly configured or preprogrammed.

Accordingly, a building according to the invention with at least two floors is distinguished by an elevator device as claimed in one of the aforementioned claims being provided.

In the case of a preferred embodiment, the second marking unit is attached to the building. This advantageously has the effect, in particular, that a relationship between the running framework or the rail of the running framework and the building is made possible. As already discussed, a non-uniform change in the position of the building in relation to the running framework may occur over time due to ageing, loads, etc. The measure of attaching the second marking unit to the building allows this relative position between the building and the running framework to be newly determined at any time, even when there is a non-uniform change, and renewed calibration to be performed. In principle, it is also conceivable for a corresponding warning function to be activated, for example by the evaluation unit, if this change in position is too great. This second marking unit may, for example, also carry floor information and position information. For example, it may include the number of the individual floor in a coded form.

The position information may be represented in various ways: one is the possibility of point information, which can be used in principle for calibration of the code strip, but also for the calculation of a position, for example of the zone in which unlocking is intended to take place. Furthermore, area information may be coded, for example making it possible for the unlocking zone to be detected directly. Such an area may be defined by a beginning and an end, for example in the case of an unlocking zone an area of approximately 20 cm below a shaft opening to 20 cm above a shaft opening. It is conceivable in principle, for example, for the beginning and the end of an unlocking zone to be detected directly on the basis of a coding on the marking unit.

It is also possible, furthermore, to transmit length information, which can be used for calibration of the code strip but can also lead to increased accuracy if the venire principle is used. Accordingly, both indirect and direct detection of the unlocking zone are conceivable in principle. Finally, the coding may likewise include floor information. In principle, image sensors may be used for reading out the first and second marking units. The marking units may likewise be used for defining a stopping point of the elevator car. In principle, it is possible to dispense with the floor information if a position can be assigned by the memory of the evaluation unit to the code read out from the marking unit. The corresponding information or assignment table must then be correspondingly stored in advance, for example in the memory of the evaluation unit. The floor information may also be obtained by detecting read-out stopping point information and also reading markings from an extreme position in the course of a learning phase during running. This measure makes good technical feasibility and low-cost implementation possible.

It is conceivable to arrange the second marking unit in such a way that the zone marked by it forms an area around at least one of the shaft openings of the elevator shaft. This zone may serve, for example, as an unlocking zone, i.e. emergency unlocking may take place in this area if the elevator remains at a standstill, for example due to a technical defect or some other unforeseen event. With the aid of the emergency unlocking, the doors can then be brought out of the elevator car through a shaft opening in an area that is safe for the persons or the objects being transported. This measure also allows the safety of the elevator device to be increased.

BRIEF DESCRIPTION OF THE DRAWINGS

An exemplary embodiment of the present invention is explained in more detail below, specifying further advantages and further details, and is represented in the drawings.

DETAILED DESCRIPTION OF THE INVENTION

Figure 1:
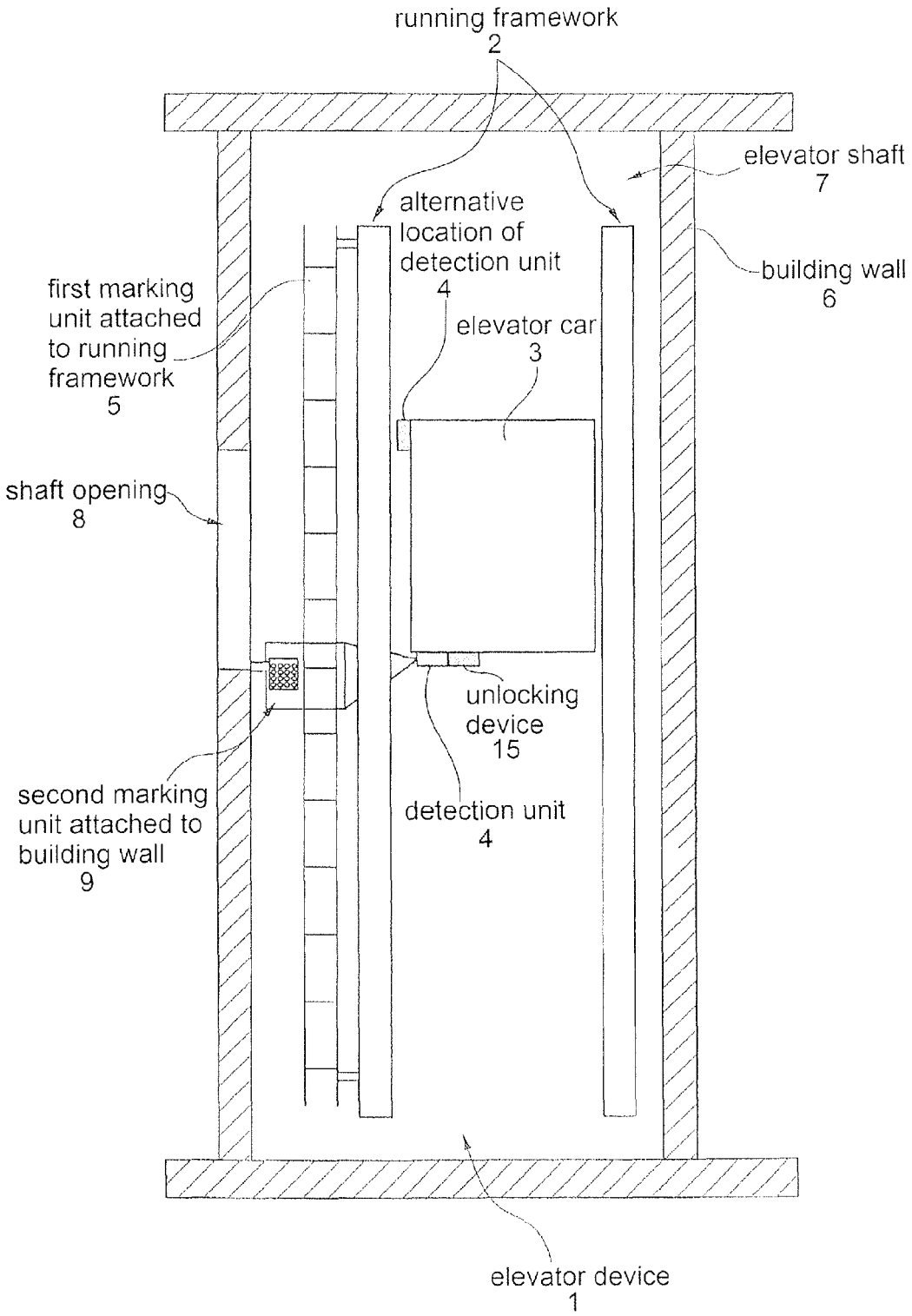
FIG. 1 shows a schematic representation of a building with an elevator according to the invention.

FIG. 1 shows an elevator device 1 with a running framework 2 and an elevator car 3. The elevator car 3 carries on its underside a camera 4. Attached to the running framework 2 is a first marking unit 5. The elevator device 1 is in turn located in a building 6, the building 6 in turn comprises an elevator shaft 7, in which in turn the elevator device 1 is arranged. In a wall of the building 6 that is adjacent the elevator shaft 7 there is in turn a shaft opening 8. At the lower edge of the shaft opening 8, a second marking unit 9 is attached to the wall of the building 6.

This exemplary embodiment is a preferred configurationally variant.

The camera 4, as an image sensor, is designed in principle for detecting and reading out both the first and the second marking unit. Persons can enter the elevator car 3 through a shaft opening 8 when said car is at the corresponding height, to be more precise at the corresponding position level with the shaft opening 8. The persons can be transported in the elevator car 3 in a vertical direction. The elevator car 3 is in turn mounted and guided by the running framework 2. Furthermore, the elevator car 3 comprises doors, which open and close automatically when the elevator car has reached a corresponding position, for example level with the shaft opening 8.

During the running of the elevator car 3 in the vertical direction, the camera 4 receives corresponding images of the first measuring unit. This image information received from the first measuring unit is processed in the evaluation unit (not represented) and finally results in a positional indication of the elevator car 3 within the running framework 2. Both the second marking unit and the first marking unit contain a barcode or 2-D code to be read out. The image area that the camera 4 detects also makes it possible, however, for the second marking unit to be read out, provided that it can be detected by the camera 4, which in turn depends on the position of the elevator car 3. As represented in FIG. 1, the camera 4 can detect the second marking unit when the elevator car 3 is in the area of the shaft opening 8. Both the second marking unit and the camera 4 on the elevator car 3 are fitted in such a way that the second marking unit can be read out at the shaft opening 8 when the elevator car 3 is located about 20 cm above or below the normal position level with the shaft opening 8, in which exiting from the elevator car usually takes place. This is the case when the floor of the elevator car is level with the floor at the shaft opening 8. This zone 20 cm above to 20 cm below the normal stopping position level with the shaft opening 8 in turn forms an unlocking zone. In the area of this unlocking zone, emergency unlocking can take place in a permissible way. Such emergency unlocking is necessary whenever the elevator car 3 suddenly remains at a standstill, for example due to an unforeseen event, a power failure, blocking of the elevator or the like. In such a case, the persons can be freed from the elevator car 3 without any particular risk if it is located in a corresponding zone that is close enough to the shaft opening 8. In this case, this zone, the unlocking zone, is approximately 20 cm above or below the shaft opening 8.

The first marking unit is formed as a strip which carries the barcode; whereas the second marking unit is formed as a 2-D code, the marking unit being formed by a marking piece. In particular, these marking units may be formed by an adhesive strip which carries the corresponding marking or the corresponding barcode or 2-D code.

Figure 2:
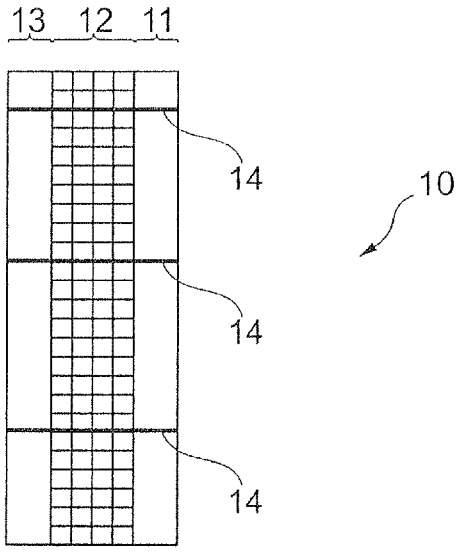
FIG. 2 shows a schematic representation of a code strip.
Figure 3:
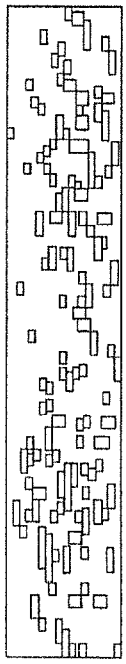
FIG. 3 shows a schematic representation of a code strip.

FIG. 2 shows an example of a corresponding marking unit, to be specific a code strip 10. If, for attachment as a second marking unit, the code strip is provided directly on a building, the area 11 may serve, for example, as floor coding, the area 12 as position coding and the area 13 as unlocking coding. In addition, there may also be marking lines 14. A coding pattern in 2-D code is shown by way of example in FIG. 3. The marking lines 14 may occur at periodic intervals. The code strip 10, 11 itself consists of a reflective foil, with corresponding black lines, areas or points printed on it for coding. The foil is, for example, adhesively attached to a metal plate or piece of metal and sealed for protection.

LIST OF DESIGNATIONS

1 Elevator device
2 Running framework
3 Elevator car
4 Camera
5 First marking unit
6 Building
7 Elevator shaft
8 Shaft opening
9 Second marking unit
10 Code strip
11 Floor coding
12 Position coding
13 Unlocking coding
14 Code strip

The invention claimed is:

1. An elevator device for transporting persons and/or objects within an elevator shaft of a building comprising at least two levels, said elevator device comprising:

an elevator car, in which the persons and/or objects to be transported can be accommodated;

a running framework including a guiding rail for mounting and guiding the elevator car;

a position determining device for determining the position of the elevator car within the elevator shaft and/or with respect to the running framework, which device comprises first and second marking units for marking the position of the elevator car, a detection unit for detecting and/or reading out the marking unit and an evaluation unit for evaluating measured values of the detection unit, wherein the marking units are formed as a carrier of a 2D barcode and the detection unit is formed as a camera, wherein the first marking unit is attached on the guiding rail of the running framework, wherein the second marking unit is attached on one of the elevator shaft and a wall of the building, the second marking unit is in the form of a reference marking for comparing the accuracy of the first marking unit, and the evaluation unit is configured to make a comparison between the first and second marking units to establish whether there is a change in relation to the relative position between the first marking unit and the second marking unit.

2. The elevator device as claimed in claim 1, wherein the marking unit is formed as a strip.

3. The elevator device as claimed in claim 1, wherein the second marking unit is attached to the elevator shaft.

4. The elevator device as claimed in claim 1, wherein the second marking unit marks a specific zone along the run within the elevator shaft.

5. The elevator device as claimed in claim 4, wherein the evaluation unit detects whether the elevator car is in the zone.

6. The elevator device as claimed in claim 1, further comprising an unlocking device for unlocking a door of the elevator car and/or a shaft opening of the elevator shaft, which device can be controlled by means of the evaluation device.

7. The elevator device as claimed in claim 1, wherein the detection unit is arranged on the elevator car.

8. A building with at least two levels and comprising an elevator device according to claim 1.

9. The building as claimed in claim 8, wherein the second marking unit is attached to the building.

10. The building as claimed in claim 9, wherein the second marking unit is arranged in such a way that the zone marked by it forms an area around at least one of the shaft openings of the elevator shaft.

11. The elevator device as claimed in claim 7, wherein the detection unit is arranged on at least one of the top and underneath the elevator car.

* * * * *